US006004911A

United States Patent [19]

Nohira et al.

[11] Patent Number: 6,004,911

[45] Date of Patent: Dec. 21, 1999

[54] PROCESSING OIL SUITABLE FOR ALUMINUM MATERIALS AND REMOVABLE VIA HEATING

[75] Inventors: Satoshi Nohira, Nishio; Takashi Ando, Iwakura; Shinya Nishihata, Nishio; Haruhiko Matsushita, Nukata-gun, all of Japan

[73] Assignee: Denso Corporation, Kariya, Japan

[21] Appl. No.: 08/777,185

[22] Filed: Dec. 27, 1996

[30] Foreign Application Priority Data

Dec. 27, 1995 [JP] Japan ..... 7-341208
Jan. 26, 1996 [JP] Japan ..... 8-011635

[51] Int. Cl.[6] ..... C10M 129/04; C10M 129/26

[52] U.S. Cl. ..... 508/539; 508/583; 508/463; 72/42

[58] Field of Search ..... 508/583, 539

[56] References Cited

U.S. PATENT DOCUMENTS

| | | | |
|---|---|---|---|
| 3,649,538 | 3/1972 | Hotten | 252/49.3 |
| 3,676,348 | 7/1972 | Unick et al. | 252/54 |
| 3,867,296 | 2/1975 | Hunt | 252/33.4 |
| 4,193,881 | 3/1980 | Baur | 252/17 |
| 4,228,217 | 10/1980 | Baur | 428/409 |
| 4,370,244 | 1/1983 | Weinhold et al. | 252/39 |
| 5,032,303 | 7/1991 | Bondpa | 252/56 R |
| 5,171,903 | 12/1992 | Koyama et al. | 585/3 |

FOREIGN PATENT DOCUMENTS

| | | |
|---|---|---|
| 57-109496 | 1/1982 | Japan . |
| 58-22887 | 2/1983 | Japan . |
| 61-129066 | 6/1986 | Japan . |
| 64-65194 | 3/1989 | Japan . |
| 2-119972 | 5/1990 | Japan . |
| 6-21579 | 6/1994 | Japan . |

*Primary Examiner*—Ellen M. McAvoy
*Attorney, Agent, or Firm*—Pillsbury Madison & Sutro LLP

[57] ABSTRACT

Work W to which oil has adhered is heated in the heating furnace 28 and adhering oil is evaporated. Gas containing the evaporated oil component is burned in the combustor 35. A portion of the generated combustion gas is circulated into the heating furnace 28 through the circulating duct 38, and an amount of the circulating combustion gas is controlled in accordance with a temperature in the heating furnace 28. Processing of aluminum materials is carried out using a base oil of hydrocarbon, the maximum molecular weight M of which is not less than 282 and not more than 378, and an additive of not less than 3% by weight of alcohol or carboxylic acid, the maximum molecular weight M of which is not more than 378.

11 Claims, 8 Drawing Sheets

PROCESSING OIL SUITABLE FOR ALUMINUM MATERIALS AND REMOVABLE VIA HEATING

BACKGROUND OF THE INTENTION

1. Field of the Invention

The present invention relates to a heating deoiling apparatus for removing machine oil adhering to pieces of work. Also, the present invention relates to a processing oil used for deoiling of aluminum materials after press forming.

2. Description of the Related Art

The manufacturing process of a conventional heat exchanger 20 (see FIG. 2) will be explained below.

The manufacturing process includes: the parts manufacturing step in which parts such as a tube 21, fin 22, tank 23 and header 24 are manufactured; the core assembling step in which the above parts are assembled; the flux coating step in which a portion to be brazed and its periphery are coated with flux; the deoiling step in which machine oil adhering onto a surface of the assembling body is removed; and the brazing step in which the assembling body is brazed, wherein these step are performed in order, so that the heat exchanger 20 can be manufactured. In the above manufacturing process of the heat exchanger 20, the deoiling step is provided for removing machine oil that has adhered onto the surfaces of parts of the assembling body in the parts manufacturing step and the core assembling step, so as to prevent the machine oil from affecting the brazing process to be conducted later. Conventionally, the deoiling step is carried out by a heating deoiling apparatus such as the one illustrated in FIG. 1.

Referring to FIG. 1, an example of the heating deoiling apparatus will be explained below. As illustrated in FIG. 3, a work piece (referred to herein as "work W") is composed as follows: A heat exchanger 20 is set on each tray 25. A large number of trays 25 on which the heat exchangers 20 are set are stacked and put on a carrier 26. The thus composed carrier 26 is conveyed by a conveyer 27.

Reference numeral 28 is a heating furnace. A plurality of heating furnaces 28 are aligned in line for heating and evaporating machine oil which has adhered to the heat exchangers 20. To the heating furnaces 28, provided are preparation chambers 29 arranged on both end sides thereof. The conveyer 27 successively passes through these preparation chambers 29 and the heating furnaces 28, so that the work W can be conveyed into and conveyed out from the apparatus.

There is provided an entrance (not shown) for the work in a boundary between the heating furnace 28 and the preparation chamber 29. Also, there is provided an entrance between the preparation chamber 29 and the outside. A shutter (not shown) is arranged at the entrance (not shown) for the work in a boundary between the heating furnace 28 and the preparation chamber 29, and preferably a shutter (not shown) is arranged at the entrance between the preparation chamber 29 and the outside. These shutters are opened only when the conveyer is driven so as to permit the work to pass through the entrance.

Each heating furnace 28 is provided with a heating burner 30 for feeding heat to the furnace, and a temperature sensor 31 for detecting the temperature in the heating furnace 28. A temperature signal detected by the temperature sensor 31 is inputted into a controller 100. In accordance with this detection signal, the controller 100 controls an amount of heat outputted from the heating burner 30.

Reference numeral 33 is an exhaust fan for exhausting oil evaporated by the heat of the heating burner 30. Evaporated oil is exhausted outside via an exhaust duct 34. Reference numeral 35 is a combustor arranged in the middle of the exhaust duct 34. The combustor 35 burns the gas containing oil sucked from the heating furnace 28, so that the gas containing oil can be changed into a clean combustion gas.

Reference numeral 37 is an agitating fan for agitating an atmosphere in the heating furnace 28. The agitating fan 37 is arranged in the ceiling portion of each heating furnace 28.

Next, the operation will be described as follows. First, the work W is conveyed by the conveyer 27 from the preparation chamber 29 on the entry side into the heating furnace 28. After the completion of conveyance, the aforementioned shutter not shown in the drawing is closed. Temperature in the heating furnace 28 is detected by the temperature sensor 31, and the temperature signal is sent to the controller 100. In accordance with the temperature signal, the controller 100 controls an amount of heat generated by the heating burner 30 of each furnace.

As a result, oil adhering to each heat exchanger 20 is heated and evaporated. The evaporated oil is sucked by the exhaust fan 33 into the exhaust duct 34 and burned by the combustor 35 arranged in the middle of the exhaust duct 34. In this way, oil can be removed. After that, the above shutter is opened, and the conveyer 27 is driven, and the work W in the furnace 28 arranged on the most right is conveyed into the preparation chamber 29 on the right. Also, the work W is conveyed from the left preparation chamber 29 into the most left furnace 28.

However, in the conventional heating deoiling apparatus, the furnace temperature is controlled only by controlling the combustion conducted in the heating burner 30. Therefore, problems may be encountered when the temperature in the heating furnace 28 is to be maintained in a preferable temperature range. These problems will be described in detail as follows.

First of all, the ignition temperature of this oil is lower than 300° C. Accordingly, from the viewpoint of safety, it is preferable that the furnace temperature is maintained at around 200° C.

Next, in the conventional heating deoiling apparatus, the heat exchanger 20 before the brazing step is bundled with a wire in order to prevent the occurrence of looseness and slippage between parts composing the heat exchanger. Even if the heat exchanger 20 is tightly bundled with the wire, when the temperature is raised to 200° C. or higher than that, the bundled heat exchanger is loosened, because an amount of linear expansion of the wire is larger than an amount of expansion of the heat exchanger 20 before the step of brazing. As a result, a relative displacement is caused between the parts of the heat exchanger, and there is a possibility that the product becomes defective. For this reason, it is preferable that the temperature of the heating furnace 28 is maintained at a value lower than 200° C. for safety.

On the other hand, the evaporation temperature of oil adhering to the parts at the atmospheric pressure is about 140 to 160° C. Therefore, when the furnace temperature becomes lower than this temperature, the evaporation speed of adhering oil is remarkably lowered. Of course, when the residence time of the heat exchanger 20 in the furnace is greatly increased before the step of brazing, it is possible to make up for this decrease of the evaporation speed. However, from the viewpoint of maintaining the productivity of the apparatus, it is actually impossible to increase the residence time of the heat exchanger 20 in the furnace.

In order to evaporate the oil adhering to the work before the step of brazing, it can be concluded that the furnace temperature must be maintained in a small temperature range, which is lower than the ignition temperature of the adhering oil and also lower than the temperature at which slippage and looseness can be caused between the bundled parts. Further the temperature range must be higher than the evaporation temperature of the adhered oil.

Because the heat generating power of the heating burner 30 used for the furnace is high, the heating burner 30 is effective for quickly raising the furnace temperature at the start of operation; but, when it is necessary to change the furnace temperature a little, hunting tends to occur in the operation of the burner, and the furnace temperature fluctuates greatly.

Also, the heating burner 30 essentially operates in such a manner that the combustion gas of high temperature not lower than 1000° C. is locally generated by the burner and agitated and mixed so as to be diffused, and the parts of the heat exchanger are heated by its radiation heat. Accordingly, temperature in each portion of the furnace tends to fluctuate in accordance with a gas current in the furnace and a state of radiation heat.

Further, in the conventional heating deoiling apparatus, the combustion gas containing oil generated in the furnace 28 is prevented from leaking outside via the preparation chamber 29 by the shutter not shown in the drawing. However, due to an imperfect air-tightness of the shutter and also due to leaks of the combustion gas caused when the shutter is opened and closed, the combustion gas containing oil leaks out via the preparation chamber 29, that is, it can be smelled outside the furnace.

In order to solve the above problems, air in the preparation chamber 29 may be sucked into the combustor 35, and oil contained in the air is burned in the combustor 35. However, when the above countermeasure is taken, the following problems are caused. Even if a shutter is arranged between the preparation chamber 29 and the outside, an amount of combustion gas flowing into the combustor 35 is increased when this countermeasure is taken. Accordingly, it becomes necessary to provide a combustor 35 of a large capacity, and further its fuel consumption is increased.

When press forming is performed, processing oil is used for improving the sliding property between a die and a piece of work to be subjected to press forming.

In the process of press forming of steel materials, processing oil of high viscosity is used to conduct press forming at a high processing rate. In this case, "the processing rate" is defined as a rate of deformation of a piece of work in the process of press forming. Also, "processing at a high processing rate" is defined as a severe processing step such as a deep drawing of a piece of work of a small diameter. In many cases, an oiliness improver such as an organic acid, the molecular weight of which is relatively large, an ester, and an extreme pressure agent such as chlorination fatty acid are added to the processing oil for processing steel materials. An example of the above processing oil is composed of a base oil belonging to the third petroleum group to which grease, the molecular weight of which is approximately 880, is added. When aluminum materials are processed, the above conventional processing oil for steel materials is also used in many cases.

For the purpose of guaranteeing the quality of products in the processes of brazing, coating, welding and surface treating to be conducted after press forming, pieces of work are subjected to a deoiling process in which the above processing oil is removed. It is necessary to remove both the base oil and the grease of high molecular weight in this deoiling process. Therefore, the following methods are adopted.

(1) Processing oil is removed by water-soluble washing.

(2) Processing oil is evaporated and removed by heating a piece of work.

Referring to FIG. 4, a case will be explained below in which deoiling is carried out by the above method (1) when aluminum materials are subjected to press forming.

Parts 1, 2 are made by press forming aluminum members. These parts 1, 2 are incorporated into a unit 3. Then the unit 3 is subjected to the process of water-soluble washing, so that the processing oil which has adhered in the process of press forming can be removed. In this process of water-soluble washing, first, the unit 3 is washed in hot water in the water bath 11. Next, in the alkali bath 12 having a plurality of cells 121, 122, 123, 124, the unit 3 is successively moved from the left end cell 121 to the right end cell 124 shown in FIG. 4. When the unit 3 is moved from the water bath 11 to the cell 121 and also when the unit 3 is drawn up from the cells 121, 122, 123, 124, an air flow is applied to the unit 3 so as to reduce an amount of solution adhering to the unit 3. In this way, the solution adhering to the unit 3 can be removed. A deoiling agent is fed from the side of the cell 124 to the alkali bath 12 filled with an alkali washing solution. The washing solution that has overflowed the cell 124 flows into the adjacent cell 123. The washing solution that has overflowed the cell 123 flows into the adjacent cell 122. The washing solution containing oil is discharged from the cell 121 to the waste water treatment equipment 15. While the unit 3 is moved from the cell 121 to the cell 124, the adhering oil is gradually removed from the unit 3. After that, in the water bath 13 having cells 131, 132, 133 and into which washing water is fed from the cell 133, the washing solution adhered to the unit 3 in the alkali bath 12 is washed away. Finally, the unit 3 is heated and dried in the drying furnace 16. In this way, the deoiling process is completed. After the completion of the deoiling process, the unit 3 is assembled into a core 4 and brazed.

However, according to the water-soluble washing method described in method (1), a large amount of waste water is produced in the water bath 11, alkali bath 12 and water bath 13, which unpreferably causes various environmental problems. Further the water treatment equipment cost and the water treatment expense are relatively high.

According to the method described in method (2), since the high molecular component in the processing oil is difficult to evaporate, it becomes necessary to provide a heating apparatus in which heating is conducted in vacuum, or it is necessary to wash for replacing the processing oil with a light oil which can be easily evaporated, before conducting heating. As a result, the equipment cost and the material expenses are increased.

On the other hand, when a rate of processing is not so high, it is possible to use processing oil of low viscosity. In this case, the following methods (3) and (4) may be adopted.

(3) Processing oil is heated and removed without replacing the processing oil with a light oil.

(4) Processing oil is evaporated by natural drying.

It is possible to execute the above method (3) at atmospheric pressure when boiling points of the base oil and the additives contained in the processing oil are sufficiently low. The above method (4) is advantageous in that it is unnecessary to conduct heating. When the above methods (1) to (4) are compared with each other, the total cost including the equipment cost and energy cost can be reduced in the order of (1)>(2)>(3)>(4).

However, the processing oil of low viscosity used in the above methods (3) and (4) is characterized in that the evaporating property is high at an ordinary temperature. Therefore, according to the conventional processing oil of low viscosity, when the apparatus stops for 2 to 3 days because of holidays, the processing oil evaporates, and lubricant starvation may be caused in the sliding sections of the die and others. Due to the foregoing, a friction coefficient between the die and the piece of work increases. Accordingly, there is a possibility that the sliding sections of the apparatus and the die are damaged when the die is repeatedly used. After the processing oil has evaporated, corrosion is caused in the die, and further oil necessary for the operation of the apparatus is removed. The above problems may be encountered according to the methods (3) and (4).

The present invention has been accomplished to solve the above problems. The first object of the present invention is to provide a heating deoiling apparatus in which adhering oil can be sufficiently removed from the work before the process of brazing by controlling the furnace temperature while ignition of adhering oil is prevented and a relative displacement of parts composing the work is suppressed.

The second object of the present invention is to accomplish the above first object while the fuel consumption is reduced and leakage of oil to the outside is prevented.

The third object of the present invention is to provide processing oil used for processing aluminum materials by which processing at a high rate can be conducted, and the processing oil can be removed by heating in the atmospheric pressure.

The fourth object of the present invention is to provide a processing oil for processing aluminum materials, the cost of which is low, and which can be removed by a deoiling method without affecting the natural environment.

SUMMARY OF THE INVENTION (A) According an embodiment of the heating deoiling apparatus of this invention, when a piece of work to which oil has adhered is heated in a heating furnace, the adhering oil is evaporated, and an oil-containing gas containing this evaporating oil component is burned. A portion of the combustion gas is circulated into the heating furnace via a circulating duct, and an amount of combustion gas to be circulated is controlled in accordance with the furnace temperature.

Due to the foregoing, when the furnace temperature is appropriately controlled, oil components adhered to the work before the process of brazing can be sufficiently removed while a relative displacement of parts composing the work is suppressed. An explanation will be made in detail as follows. Compared with a case in which the furnace temperature is controlled by a heating burner 30 of a large heat capacity, in the apparatus of the invention, combustion gas discharged from a combustor 35, in which gas containing oil is burned, is circulated to the furnace, and an amount of combustion gas circulated in this way is controlled for adjusting the furnace temperature. Usually, the temperature of combustion gas is approximately 400° C., which can be stably maintained. Further, this temperature of combustion gas is much lower than the flame of the heating burner 30 arranged in the furnace. Therefore, the combustion gas is capable of heating the furnace uniformly, and when a flow rate of the circulated combustion gas is controlled, it is possible to control an amount of heat accurately. As a result, the fluctuation of furnace temperature can be suppressed and the occurrence of hunting can be prevented.

In this connection, when oil adhered to the work before the process of brazing is removed, it is necessary to control the work temperature (furnace temperature) in a predetermined narrow range. This necessity has already been explained before. Therefore, the explanation will be omitted here.

In addition to the above advantages, in the apparatus of the invention, combustion gas is circulated after it has been discharged from the combustor. Therefore, it is possible to reduce a fuel consumption of the furnace in accordance with an amount of combustion gas circulated in this way. It is possible to heat the furnace only by the circulating combustion gas sent from the combustor. However, from the viewpoint of shortening the rising time of the furnace, it is preferable to arrange the furnace heating burner in each furnace. Further, for the purpose of controlling the furnace temperature, it is natural to combine controlling an amount of circulating combustion gas and adjusting an amount of heat generated by the furnace heating burner.

However, in order to exhibit the characteristic of the present invention, which is to reduce the fluctuation of furnace temperature, it is preferable that the furnace temperature is controlled by adjusting an amount of combustion gas to be circulated after the furnace operation has risen. When consideration is given to the fluctuation of temperature of each portion in the furnace caused by radiation heat of the heating burner, it is preferable that heat is input into the furnace by the circulation of combustion gas after the furnace operation has risen. However, in the case where no heating burner is arranged in the furnace, it is preferable to reduce the rising time of the furnace in such a manner that an amount of heat generated by the combustor is temporarily increased in the rising operation of the furnace to a value higher than an amount of heat generated in the steady combustion of oil contained in the combustion gas.

Feedback control of an amount of combustion gas to be circulated is conducted in such a manner that the furnace temperature is simply compared with the target temperature, and an amount of combustion gas to be circulated is controlled so that the temperature difference can be removed. Of course, other conventional controlling systems may be adopted. For example, the following control systems may be adopted. A rate of change in the furnace temperature is measured, and a rate of change in the amount of combustion gas to be circulated is controlled in accordance with the rate of change in the furnace temperature. Also, when the temperature and flow speed of combustion gas to be circulated are detected and an amount of heat of the circulated combustion gas is accurately calculated and feedback control is conducted in accordance with the result of calculation, the occurrence of errors and hunting can be prevented. In the case where there is a large temperature difference between the detected furnace temperature and the target temperature, a rate of change in the amount of circulated combustion gas with respect to the amount of equilibrium combustion gas (the average amount of combustion gas) may be made to be high, and as a temperature difference is reduced, the above rate of change may be reduced so as to prevent the occurrence of hunting. The specific structure of various feedback controls described above can be changed when a variable of the microcomputer is modified a little. Therefore, an explanation of the specific structures of various feedback controls is omitted here.

The simplest method of control is that an amount of circulating combustion gas is adjusted by a damper arranged in the duct. However, it is also possible to adjust an amount of circulating combustion gas by a fan, capable of rotating by stepless regulation, arranged in the duct.

According to another embodiment of the apparatus of this invention, in the apparatus described above, an amount of circulating combustion gas used for controlling the furnace temperature is adjusted so that a concentration of the evaporated oil component in the furnace is outside a range of an explosive mixture. Due to the foregoing, it is possible to prevent an explosion in the furnace.

According to another embodiment the apparatus of this invention, in the embodiments of the apparatus described above, the furnace is provided with a heating burner for heating the furnace. Accordingly, it is possible to shorten the rising time of the furnace. From the viewpoint of preventing the occurrence of hunting, it is preferable that an amount of heat generated by the burner is gradually reduced in accordance with the temperature rise in the furnace.

This invention further contemplates other modifications to the above-described embodiments. For example, a blowing means may be arranged on the downstream side of the combustor. Due to the above arrangement, the blower is not stained.

A plurality of furnaces can be aligned in line with each other, and an amount of combustion gas circulating to each furnace can be controlled by each auxiliary damper, and an amount of the entire combustion gas can be controlled by a primary damper. Accordingly, combustion gas can be accurately controlled.

The detail of control of combustion gas will be explained as follows. When auxiliary dampers are closed one-by-one, the pressure of combustion gas in the circulation duct on the upstream side of the auxiliary damper increases accordingly. As a result, a pressure difference at the auxiliary dampers is increased. Therefore, even if some auxiliary dampers are closed, an amount of circulating combustion gas can not be reduced, so that the control latency is increased. On the other hand, when the degree of opening of some auxiliary dampers is high, the above phenomenon is not caused. Accordingly, even when other auxiliary dampers are closed, of course, the pressure differences at said some auxiliary dampers are small. Therefore, in the apparatus of the invention, fluctuation of pressure in the common duct in the upstream of the circulation duct is suppressed, so that the above problems can be prevented.

In this connection, the control parameters for controlling the primary damper may include the pressure in the common duct, the degree of opening of each auxiliary damper, the detected temperature in each furnace, and the deviation of the detection temperature in each furnace from the target temperature (temperature difference).

In accordance with another embodiment of the apparatus of this invention, there are provided preparation chambers on both sides of the furnaces, and combustion gas is discharged from these preparation chambers via an electric dust collector, so that the oil contained in combustion gas can be recovered by the electric dust collector.

Due to the above arrangement, it is possible to prevent the oil and smell from leaking outside, and further the combustor can be made compact and the fuel consumption can be reduced because air at low temperature is prevented from flowing from the preparation chamber into the combustor.

(B) In order to solve the aforementioned problems relating to the processing oil for processing aluminum materials, it is preferable that the processing oil for processing aluminum materials of the present invention is provided with the following characteristics.

(1) The processing oil for processing aluminum materials belongs to the third petroleum group.

Most of the conventional processing oils belong to the third petroleum group. Therefore, when the processing oil of the present invention belongs to the third petroleum group, management of the processing oil can be advantageously performed.

(2) The complete evaporation temperature is not lower than an ordinary room temperature and not higher than 200° C.

Heat deoiling to be conducted at atmospheric pressure is carried out at temperatures lower than the ignition temperature of the processing oil. Since the ignition range of flammable liquids belonging to the third petroleum group is approximately 200 to 300° C., the complete evaporation temperature of processing oil of the present invention is preferably not higher than 200° C. Also, in order to save energy and shorten the deoiling time, it is preferable that the complete evaporation temperature is in a range higher than the room temperature but as low as possible. In this specification, "the complete evaporation temperature" is defined as a temperature at which the residual weight becomes zero when the temperature is raised from the room temperature at a rate of 10° C./min in the differential thermal analysis in which a sample of 10 mg is used. At this time, it is possible to assume that the adhering processing oil has been removed so that the steps of brazing, coating, welding and surface treatment, which will be executed after the step of press forming, are not affected. For this reason, "the complete evaporation temperature" is used as a target of the lower limit of the heating temperature at which deoiling can be carried out in the atmospheric pressure.

(3) The processability is at the same level as that of the conventional processing oil or higher than that.

(4) An oil film can be kept after being left at the ordinary temperature for 72 hours.

The reason why an oil film must be kept is described as follows. When the apparatus has stopped, i.e., shut down, for a day off, it is necessary to prevent damage to an oil film, which covers the surfaces of the die and other parts. For example, when the apparatus is stopped from 5 p.m. of Friday to 8 a.m. of Monday in the next week, the stop time is 64 hours. Time to spare (8 hours) necessary for keeping an oil film safely is added to the aforementioned 64 hours, that is, 64 hours and 8 hours make 72 hours. In other words, it is preferable that the oil film can be kept in a good condition even after 72 hours.

When consideration is given to the above methods (1) to (4), the processing oil for processing aluminum materials in accordance with a first embodiment of the present invention comprises: a base oil composed of hydrocarbon, the maximum molecular weight of which is not less than 282 and not more than 378; and an additive of 3% by weight or more composed of alcohol or carboxylic acid, the maximum molecular weight of which is not more than 378.

The reason why the maximum molecular weights of the base oil and the additive are determined to be not more than 378 is described as follows. When the maximum molecular weights of them exceed 378, the complete evaporation temperature is raised too high, so that the total energy cost necessary for deoiling is increased and further the deoiling time is increased. When the maximum molecular weight of the base oil is smaller than 282, the evaporation speed at the ordinary temperature is increased too high, so that an oil film tends to be damaged. Therefore, the maximum molecular weight of the base oil is determined to be not less than 282. The reason why alcohol or carboxylic acid, the weight of which is not less than 3% by weight, is added is to obtain the processability of the same level as that of the conventional processing oil. In this case, "the processability" represents a characteristic of processing oil to determine the rate of processing in press forming. When processing oil of a higher processability is used, it is possible to conduct press forming on a piece of work, the rate of processing of which is high. The more an amount of additive is increased, the higher the processability is enhanced. However, in general, alcohol and carboxylic acid are more expensive than hydrocarbon. Therefore, it is preferable that an amount of additive is not more than 20% by weight. It is more preferable that an amount of additive is not more than 10% by weight.

When the rate of processing of aluminum materials is not so high, a processing oil is selected while importance is attached to the deoiling property rather than the processability. Processing oil for processing aluminum materials described hereinbelow as the second embodiment is appropriate in the above case.

The processing oil for processing aluminum materials in accordance with the second embodiment of the present invention comprises: a base oil composed of hydrocarbon, the maximum molecular weight of which is smaller than 282; and an additive of 3% by weight or more composed of alcohol or carboxylic acid, the maximum molecular weight of which is not less than 282 and not more than 378.

According to the oil for this second embodiment, the maximum molecular weight of the base oil is less than 282. Therefore, the complete evaporation temperature of the processing oil is lower than that of the processing oil described above in the first embodiment, and further the deoiling property of the processing oil of the second embodiment can be enhanced more than the deoiling property of the processing oil of the first embodiment. Since the maximum molecular weight of alcohol or carboxylic acid to be used as an additive is not less than 282, even after the base oil, the maximum molecular weight of which is small, has evaporated, this additive remains, so that the damage to an oil film can be effectively prevented. Since the maximum molecular weight of this additive is not more than 378, the residual additive can be easily removed by means of deoiling conducted in the atmospheric pressure. When the content of alcohol or carboxylic acid is increased, the processability of processing oil is enhanced, however, there is a tendency that the complete evaporation temperature of processing oil is raised, and further alcohol or carboxylic acid is generally more expensive than hydrocarbon. Therefore, it is preferable that an amount of additive is not more than 20% by weight, and it is more preferable that an amount of additive is not more than 10% by weight.

For processing aluminum materials in which importance is mostly attached to the deoiling property, the additive content should be 3 to 20 weight %.

In accordance with one variation of the present invention, the processing oil comprises: a base oil composed of hydrocarbon, the maximum molecular weight of which is smaller than 282; a first additive of not less than 3% by weight composed of alcohol or carboxylic acid, the maximum molecular weight of which is smaller than 282; and a second additive of not less than 0.25% by weight composed of ester, the maximum molecular weight of which is not less than 282 and not more than 378.

According to a third embodiment of the processing oil for processing aluminum materials described in claim 14, the maximum molecular weights of both the base oil and the first additive are smaller than 282. Therefore, the complete evaporation temperature of the processing oil is low, and the deoiling property is high. The processing oil contains the second additive composed of ester of 0.25% by weight, the maximum molecular weight of which not less than 282 and not more than 378. Even after the base oil, the maximum molecular weight of which is small, has evaporated, this second additive remains, so that the damage of an oil film can be effectively prevented. Since the maximum molecular weight of this second additive is not more than 378, the residual additive can be easily removed by means of deoiling conducted at atmospheric pressure. In this connection, when the content of ester is increased, the effect of prevention of the damage to an oil film can be enhanced, however, there is a tendency that the complete evaporation temperature of the processing oil is raised. Further, since ester is generally more expensive than hydrocarbon, it is preferable that the content of ester is not more than 10% by weight, and it is more preferable that the content of ester is not more than 5% by weight. When an amount of the first additive is increased, the processing property is enhanced, however, since alcohol or carboxylic acid is generally more expensive than hydrocarbon, it is preferable that an amount of the first additive is not more than 20% by weight, and it is more preferable that an amount of the first additive is not more than 10% by weight.

DESCRIPTION OF THE PREFERRED EMBODIMENTS

Preferred embodiments of the present invention will be explained below will referring to the following examples.

(A) First of all, the heating deoiling apparatus will be explained as follows.

Figure 1:
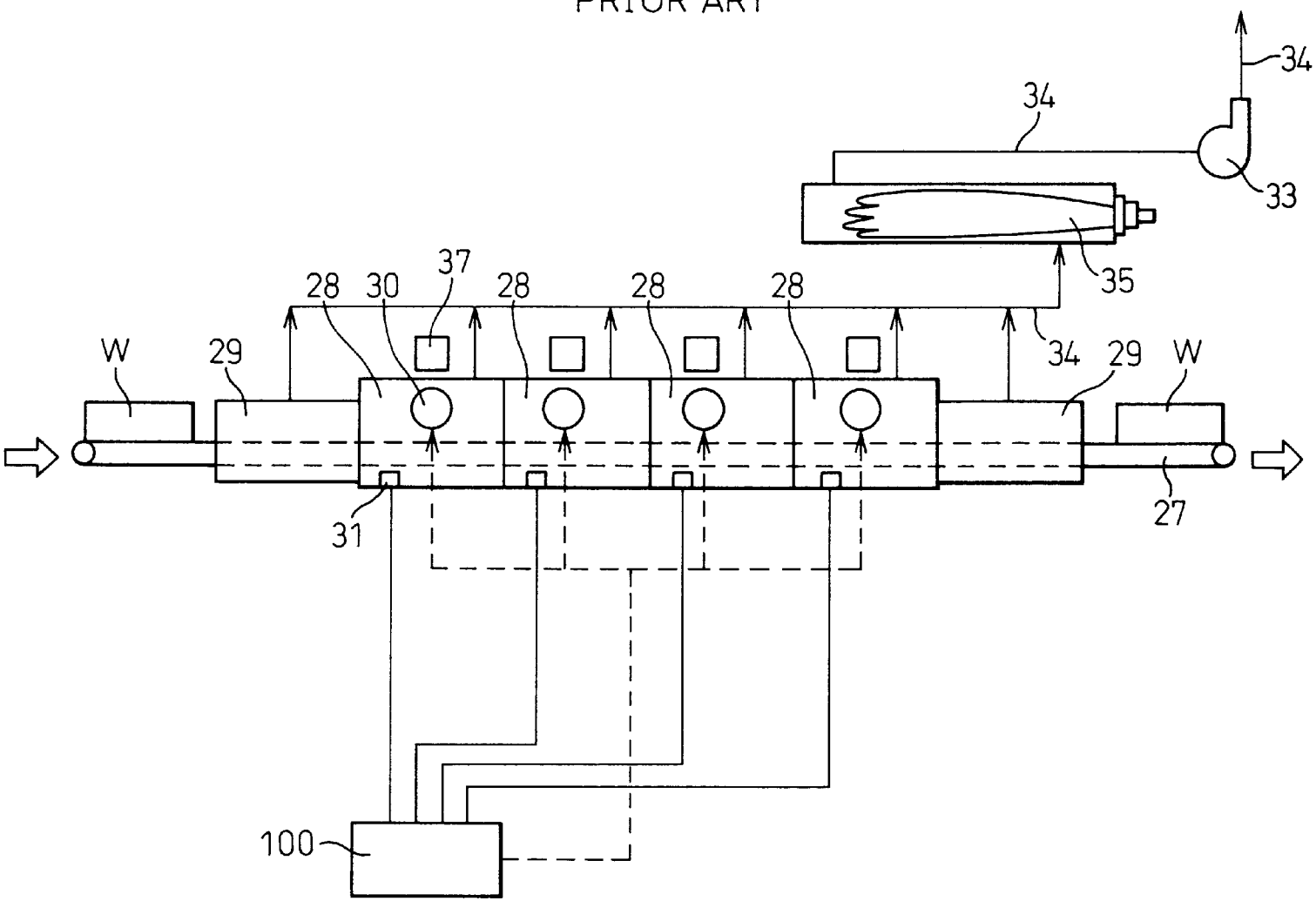
Fig. 1 PRIOR ART
FIG. 1 is a schematic illustration showing an example of the conventional heating deoiling apparatus.
Figure 5:
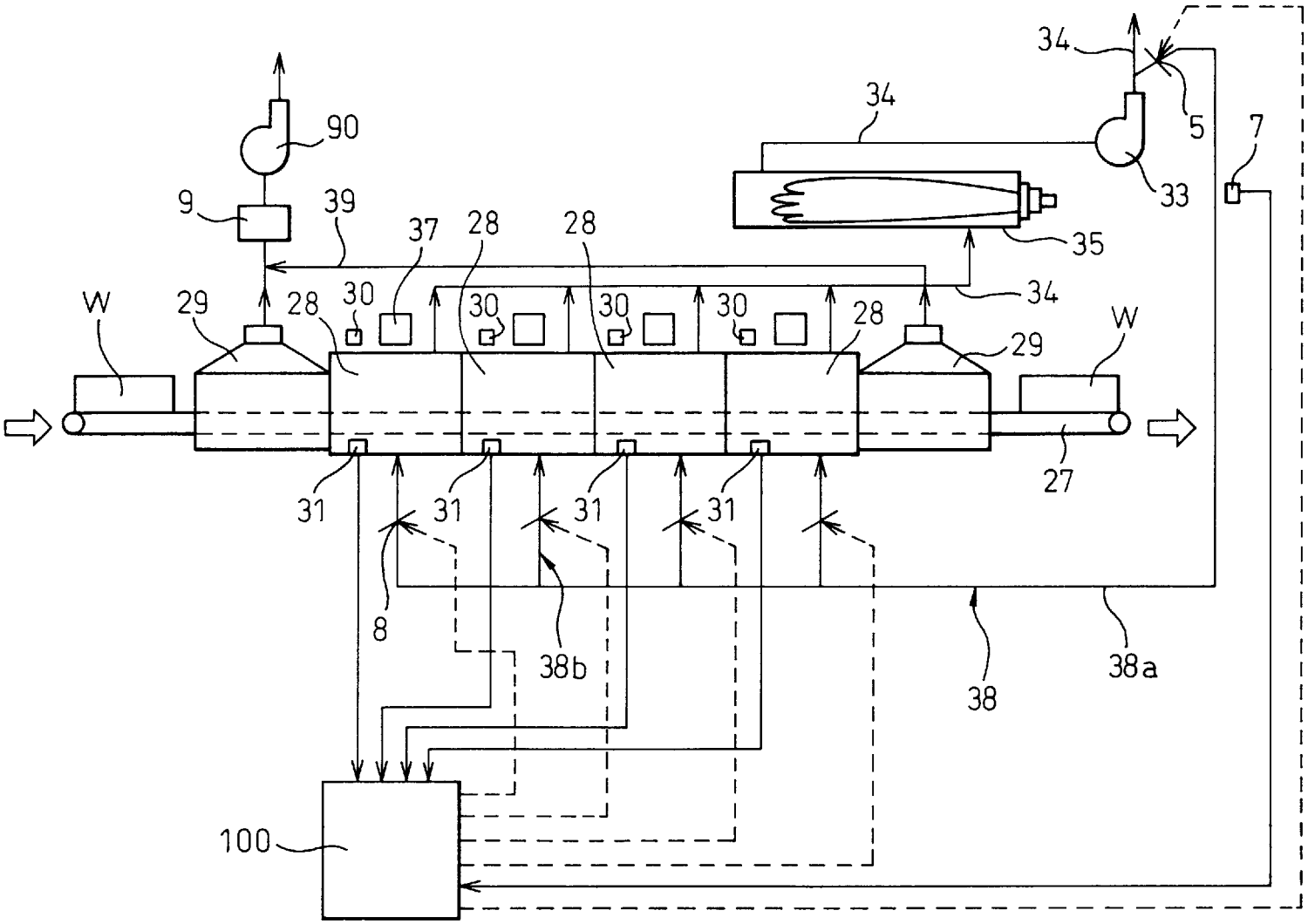
FIG. 5 is a schematic illustration showing an example of the heating deoiling apparatus of the present invention.

FIG. 5 is a schematic illustration showing an example of the heating deoiling apparatus of the present invention. This heating deoiling apparatus is composed in such a manner that a circulation duct 38, a primary damper 5, auxiliary dampers 8, a pressure sensor 7 and an electric dust collector 9 are added to the conventional heating deoiling apparatus shown in FIG. 1.

Figure 2:
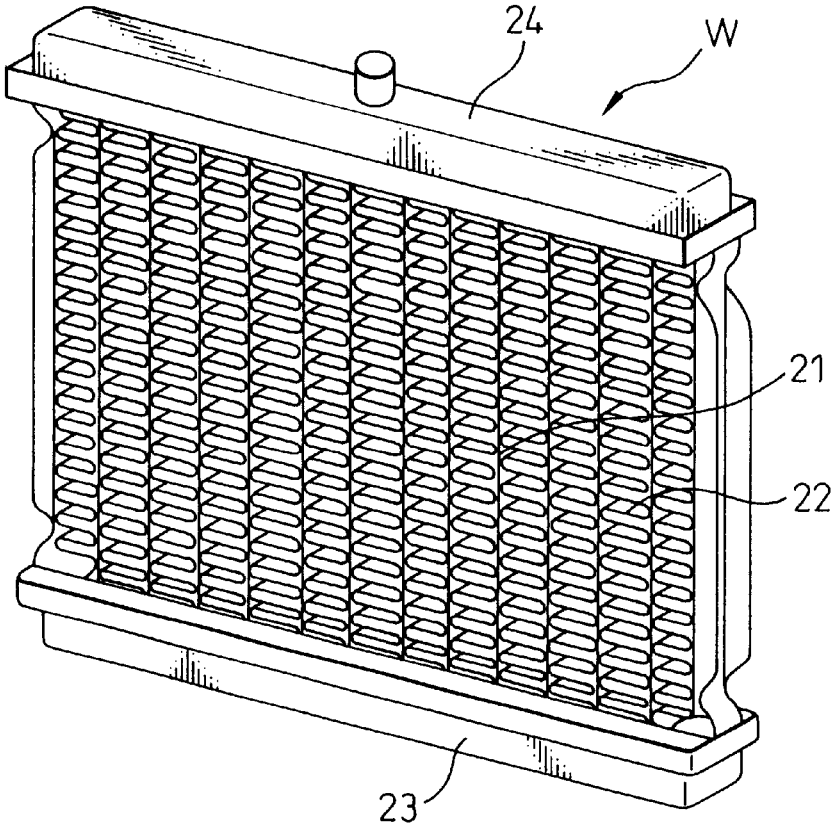
FIG. 2 is a perspective view of the heat exchanger in which deoiling is performed.
Figure 3:
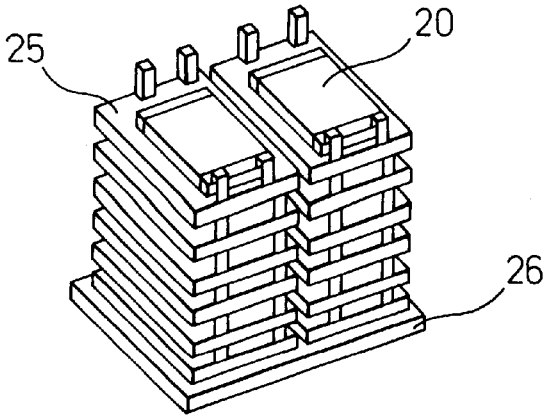
FIG. 3 is a perspective view of the work in which the heat exchangers are stacked.

Explanations will be made in detail as follows. The work W is composed by stacking the heat exchangers 20 illustrated in FIGS. 2 and 3. Since the explanation of the work W has been made before, it will be omitted here. However, in each heat exchanger 20, components such as a tube 21, fins 22, tank 23 and header 24 are bundled by a wire not shown, so that the components cannot be shifted from predetermined positions. A portion to be brazed is previously coated with flux. The reason why the heating deoiling process is carried out after the completion of coating of flux is that when the heating deoiling process is carried out before the completion of coating of flux, it is necessary to cool the work W for the purpose of coating flux, and the thermal economy is deteriorated.

Reference numeral 28 represents four sets of furnaces which are aligned in line being adjacent to each other so as to heat and evaporate oil adhering to the heat exchanger 20. Preparation chambers 29 are respectively attached to the furnaces 28 arranged at both end portions. The conveyer 27 successively passes through these preparation chambers 29 and the furnaces 28 so that the work W can be conveyed in and out. There is provided a work entrance (not shown) at the boundary between the furnace 28 and the preparation chamber 29. Also, there is provided a work entrance (not shown) between the preparation chamber 29 and the outside. In each work entrance, there is provided a shutter (not shown). Only when the conveyer is driven, is this shutter opened so that the work can pass through the entrance.

Reference numeral 33 is an exhaust fan, which is attached to an exhaust duct 34 to discharge oil that has evaporated by the heat of the heating burner 30. Therefore, evaporated oil is discharged outside via the exhaust duct 34. Reference numeral 35 is a combustor arranged in the middle of the exhaust duct 34. In the combustor 35, gas containing oil, which has been sucked from the furnace 28 by the exhaust fan 33, is burned, so that it can be changed into a clean combustion gas. Reference numeral 37 is an agitating fan to agitate gas in the furnace 28. The agitating fan 37 is arranged in the ceiling of each furnace 28.

There is provided a circulating duct 38 which branches from the exhaust duct 34 at the downstream of the exit of the exhaust fan 33. In a common duct 38*a* arranged in the upstream of the circulating duct 38, there are provided a pressure sensor 7 and a primary damper 5 composed of a proportional control damper device driven by a motor. On the other hand, four branch ducts 38*b*, which are respectively open into the furnaces 28, branch from the downstream of the exhaust duct 34. In each branch duct 38*b*, there is provided an auxiliary damper 8 composed of a proportional control damper device driven by a motor.

Reference numeral 9 is an electric dust collector, and reference numeral 90 is an exhaust fan. Exhaust gas is sucked by the exhaust fan 90 from the ceiling of the preparation chamber 29 via the duct 34 and the electric dust collector 9 and discharged outside. In each furnace 28, there is provided a temperature sensor 31 to detect the temperature in the furnace 28. A furnace temperature signal from the temperature sensor 31 is sent to a controller 100 composed of a microcomputer. The controller 100 controls the primary damper 5 in accordance with a pressure signal outputted from a furnace pressure sensor 7 according to the pressure in the common duct 38*a*. The controller 100 controls the auxiliary damper 8 in accordance with the furnace temperature signal detected by a temperature sensor 31.

Next, an operation will be explained below. First, the combustor 35, the exhaust fans 33, 90 and the electric dust collector 9 are operated, and the work W is conveyed by the conveyer 27 from the preparation chamber 29 on the entrance side into the furnace 28. After the work W has been conveyed into the furnace 28, the above shutter (not shown) is closed, and the primary damper 5 and the auxiliary dampers 8 are opened so as to heat the furnace 28. In accordance with the furnace temperature signal sent from the temperature sensor 31, the controller 100 controls the auxiliary damper 8, so that the temperature in each furnace 28 is maintained at 180° C. Further, in accordance with the pressure signal sent from the pressure sensor 7, the controller 100 controls the primary damper 5, so that the pressure in the circulating duct 38 can be maintained at a constant value.

After the temperature in the furnace 28 has been stabilized at 180° C., the conveyer 27 is intermittently operated, and the above shutter is opened and closed synchronously with the conveyer 27, so that each work can be made to stay in each preparation chamber 29 and furnace 28 for a predetermined period of time. Due to the foregoing operation, oil adhering to the work W can be evaporated. Gas containing oil that has evaporated in the furnace 28 is sucked into the exhaust duct 34 by the exhaust fan 33, and oil is burned and removed by the combustor 35 arranged in the middle of the exhaust duct 34. Oil that has leaked into the preparation chamber 29 is attracted to an electrode of the electric dust collector 9 by an electrostatic force together with air in the preparation chamber 29. In this way, oil can be recovered.

Figure 6:
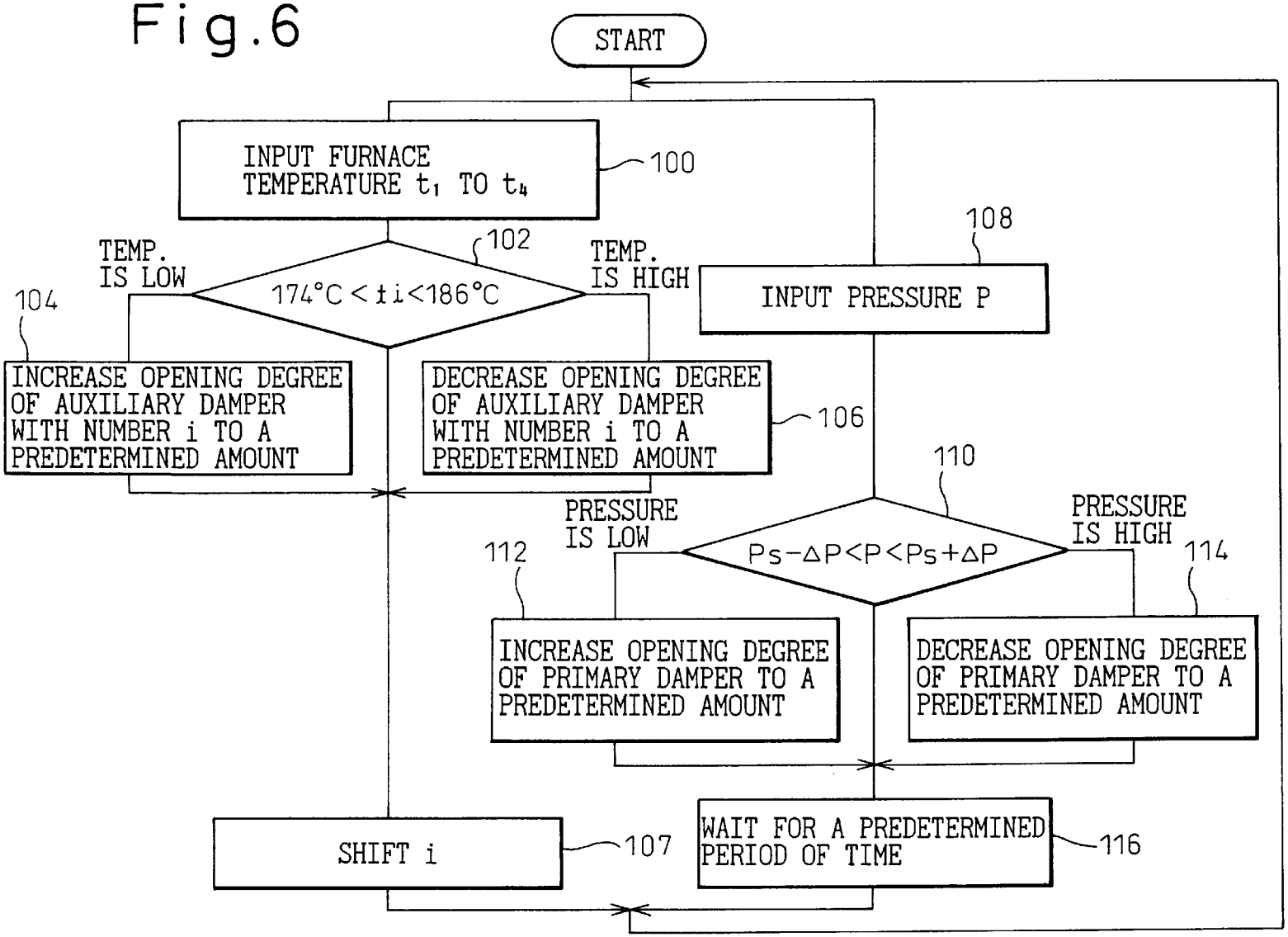
FIG. 6 is a flow chart showing a controlling operation of the controller shown in FIG. 5.

FIG. 6 is a flow chart of the furnace temperature control conducted by the controller 100 in this example.

First, the temperature sensors 31 detect the furnace temperatures $t_1$ to $t_4$ of the furnaces 28 (step 100). It is determined whether or not the furnace temperature $t_i$ among the detected furnace temperatures $t_1$ to $t_4$, the number "i" of which coincides with the number stored in a register housed in the controller, is in a preferable temperature range, from 160 to 200° C. (step 102). In this connection, the number "i" is one of the integers of 1 to 4. As a result of the determination, when the furnace temperature $t_i$ is lower than the preferable temperature range, the degree of opening of the auxiliary damper 8, the number of which is "i", is increased by a predetermined amount of opening, so that the furnace temperature of the furnace 28, the number of which is "i", is raised (step 104). When the furnace temperature $t_i$ is higher than the preferable temperature range, the degree of opening of the auxiliary damper 8, the number of which is "i", is decreased by a predetermined amount of opening, so that the furnace temperature of the furnace 28, the number of which is "i", is lowered (step 106). Then the program proceeds to step 107. When this furnace temperature $t_i$ is in the preferable temperature range, the program directly proceeds to step 107.

In step 107, the register housed in the controller, which is a shift register circulating in the order of 1, 2, 3, 4, 1, 2 is shifted by one, so that the program returns to step 100. In parallel with the above control conducted in accordance with temperature, the control conducted in accordance with pressure is also conducted. That is, pressure P in the circulating duct 38 is read in by the pressure sensor 7 and, in the next step 110, it is discriminated whether or not the pressure P, which has read in before, is in a preferable pressure range $[(P_s-\Delta P)$ to $(P_s+\Delta P)]$. In this connection, $P_s$ is one atmospheric pressure, and the above range is an allowable deviation when $P_s$ is used as a reference.

As a result of the above discrimination, when the pressure P is lower than the above preferable pressure range, the degree of opening of the primary damper 5 is increased by a predetermined amount of opening, so that the pressure in the circulating duct 38 is raised (step 112). When the pressure P is higher than the above preferable pressure range, the degree of opening of the primary damper 5 is decreased by a predetermined amount of opening, so that the pressure in the circulating duct 38 is lowered (step 114). Then the program proceeds to step 116. When the pressure P is in the preferable pressure range, the program directly proceeds to step 116.

In step 116, the program waits for a predetermined period of time and returns to step 100.

According to the above apparatus of this example, the conventional heating burner is not used. Accordingly, it is possible to provide the following advantages. When the conventional heating burner is used, one portion of the surface of the work exposed to the flames of the burner is intensely heated by radiant heat. Therefore, this portion of the work is heated to a higher temperature than that of the other portion of the surface of the work which is not exposed to the flames of the burner. According to the apparatus of this example, the above disadvantages can be avoided.

In the above example, the work W is a heat exchanger 20 before the brazing step. However, it should be noted that the work W is not limited to the heat exchanger 20. Of course, any metallic part to which oil adheres may be used as the work.

In the above example, four furnaces 28 are used. However, it should be noted that the number of furnaces can be arbitrarily determined.

After the temperature has been controlled in accordance with temperature and pressure, the pressure may be controlled.

(B) Next, processing oil used for the above heating deoiling apparatus will be explained as follows. First, the selection of processing oil of the present invention is described below.

[1] Relation Between the Maximum Molecular Weight M and the Complete Evaporation Temperature T The complete evaporation temperatures T were measured for the processing oil samples A to F, the base of which is hydrocarbon, shown on Table 1. Measurement was conducted by means of differential thermal analysis in which samples of 10 mg were used. In the measurement, the temperature was raised from the room temperature at a rate of 10° C./min. Temperature at which the residual weight became zero was defined as the complete evaporation temperature T. These samples A to F were prepared as follows. The base oil was hydrocarbon, and the additive was selected from various greases, fatty acids, esters and alcohols, the maximum molecular weight M of which was 183 to 880, and the amount of which was not more than 20% by weight. A plurality of the above samples were prepared, and the complete evaporation temperatures T of the samples were measured.

TABLE 1

| Sample No. | Average molecular weight | Maximum molecular weight |
|---|---|---|
| A | 240 | 340 |
| B | 274 | 420 |
| C | 183 | 212 |
| D | 170 | 230 |
| E | 232 | 400 |
| F | 120 | 880 |

Figure 7:
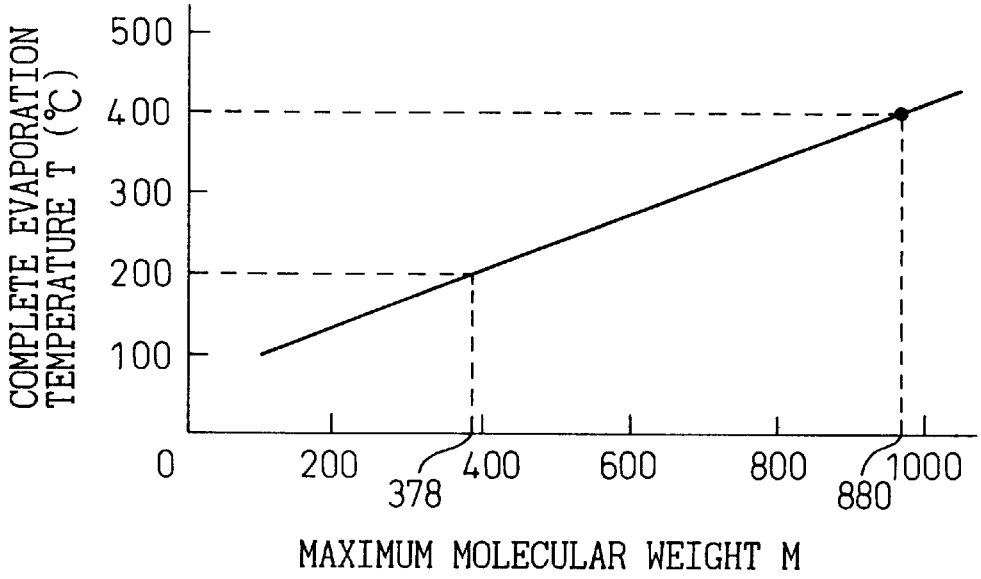
FIG. 7 is a characteristic diagram showing a relation between the maximum molecular weight and the complete evaporation temperature of oil.

FIG. 7 is a characteristic diagram made according to the above result of measurement on which a relation between the maximum molecular weight M of substance contained in each sample and the complete evaporation temperature T is plotted. The following regression equation (a) was obtained from the above characteristic diagram.

$$T=0.36M+63.851 \quad \text{(a)}$$

According to the above regression equation (a), the following can be concluded. Hydrocarbon, the maximum molecular weight M of which is not more than 378, is used as the base oil, and one of grease, fatty acid, ester and alcohol, the maximum molecular weight of which is not more than 378, is used as the additive. In the case of processing oil which contains the above base oil and additive, the complete evaporation temperature T is not higher than 200° C. Accordingly, it becomes possible to conduct heating deoiling in the atmospheric pressure at temperatures not higher than 200° C. In the case of the conventional processing oil which contains a base oil belonging to the third petroleum group and an additive of grease, the molecular weight of which is approximately 880, the complete evaporation temperature T reaches 400° C. Therefore, it can be understood in FIG. 7 that heating deoiling can not be executed in the atmospheric pressure at temperatures not higher than 200° C.

[2] Investigation into the Processing Property

Mineral oil and synthesized hydrocarbon are used for the base oil of processing oil. According to the composition of the above base oil, there are no polar groups. Therefore, the adsorption property onto the surface of aluminum materials is not sufficiently high. Accordingly, it is impossible to provide a sufficiently high processability. In order to improve the processability, it is effective to add an additive composed of a chemical compound having a polar group such as a carboxyl group, hydroxyl group and ester group. Examples of the above additive are: grease, fatty acid, ester, and alcohol, which are used in the conventional processing oil. The effect of improvement in the processability is increased in the order of alcohol<ester<fatty acid<grease.

Since the molecular weight of grease is large, it was rejected from an investigation, and the investigation to improve the processing property was made into fatty acid, ester and alcohol, the maximum molecular weights of which were not more than 378. Hydrocarbon of paraffin group, the average molecular weight of which was 183 (the maximum molecular weight M was 212) was used as a base oil. Effect of improvement in the processing property was evaluated by the cylindrical deep drawing test. That is, an aluminum disk was prepared so that it could be processed. Cylindrical deep drawing was conducted on this aluminum disk by a punch. A drawing ratio was found when "diameter D of the largest aluminum disk capable of being drawn" was divided by "punch diameter d". When the drawing ratio is high, it is possible to conduct drawing at a high rate of processing, that is, when the drawing ratio is high, the processability can be enhanced.

Figure 8:
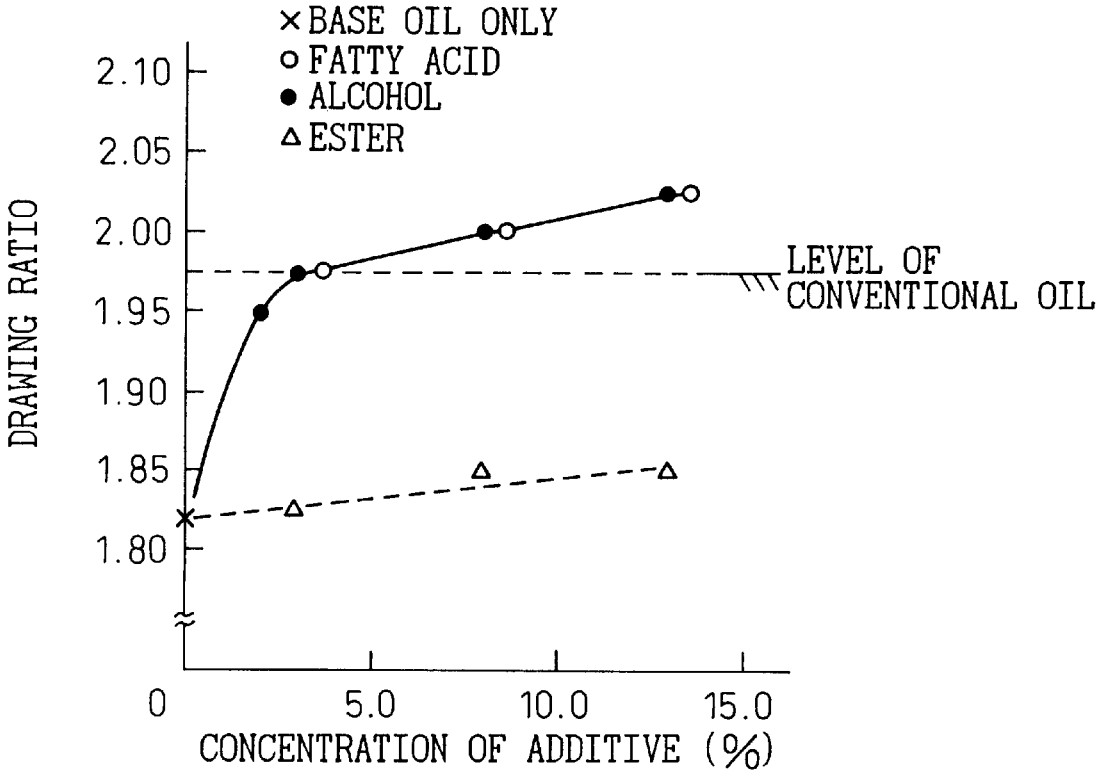
FIG. 8 is a characteristic diagram showing a relation between the concentration of additive and the processability.

FIG. 8 is a graph showing a relation between an amount of concentration of additive and a ratio of drawing, wherein the relation is shown with respect to the types of additives. In this connection, "Level of the conventional oil" described in FIG. 8 represents a ratio of drawing that was found in the cylindrical deep drawing of an aluminum disk when the conventional processing oil for steel materials was used, in which grease of which the maximum molecular weight M was 880 was added to mineral oil.

From FIG. 8, it can be understood that the processability higher than that of the conventional processing oil can be obtained by adding an additive of not less than 3% by weight composed of fatty acid or alcohol to the base oil.

In this connection, carboxylic acid except for fatty acid may be used as additive. However, in order to make the polar group tightly adhere onto the surface of aluminum materials, it is preferable to use fatty acid, especially linear monocarboxylic acid. Further, in order to prevent the corrosion of the die and also in order to reduce the material cost, alcohol, especially chain-type alcohol may be more preferably used than carboxylic acid. Further, a mixture of alcohol and carboxylic acid may be used as additive.

[3] Investigation into the Evaporation Speed V

Figure 9:
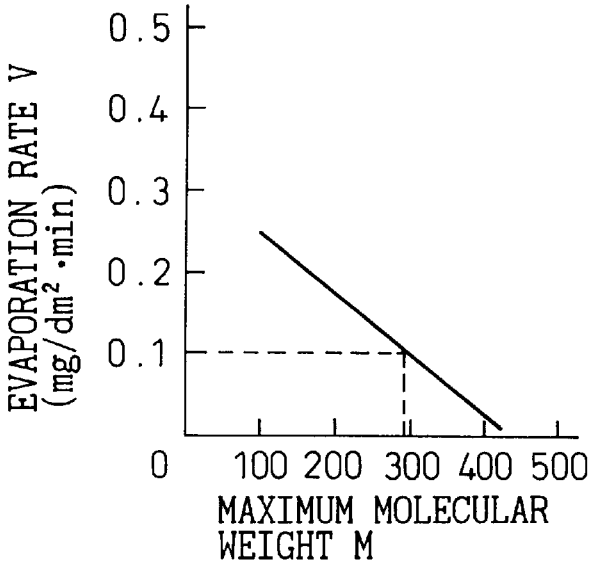
FIG. 9 is a characteristic diagram showing a relation between the maximum molecular weight and the evaporation speed.

Aluminum sheets were dipped in various types of hydrocarbons, the maximum molecular weights M of which were different. Then the aluminum sheets were taken out from the hydrocarbon, and the evaporation speed V was found by a speed of decrease of the weight. FIG. 9 is a characteristic diagram showing a relation between the maximum molecular weight M and the evaporation speed V. The following regression equation (b) was found from this characteristic diagram.

$$V=-0.00076M+0.33 \quad \text{(b)}$$

In the process of press forming of aluminum materials, an amount of processing oil adhering to components of the apparatus is usually 500 to 2000 mg/dm$^2$. When a portion of processing oil adhering to the apparatus remains after 72 hours from the stoppage of the apparatus, it is possible to prevent the occurrence of lubricant starvation in the stoppage of the apparatus in a day off. By the following equation (c), the evaporation speed V was found, at which the minimum adhering amount 500 mg/dm$^2$ of processing oil was evaporated in 72 hours, that is, in a period of time shorter than 4320 minutes.

$$500[\text{mg/dm}^2]/4320[\text{min}]=0.115[\text{mg/(dm}^2\text{min)}] \quad \text{(c)}$$

As shown in FIG. 9, when the maximum molecular weight M is not less than 282, the evaporation speed V is not more than 0.115 mg/dm$^2$ min. Accordingly, when the maximum molecular weight M is not less than 282, a portion of processing oil remains even after 72 hours at the minimum adhering amount 500 mg/dm$^2$. Therefore, the occurrence of lubricant starvation can be prevented.

From the result of the investigation conducted in the above items [1] to [3], the following can be concluded. It is possible to prevent the occurrence of lubricant starvation and it is also possible to conduct heating deoiling in the atmospheric pressure by using processing oil characterized in that: the processing oil is composed of a base oil of hydrocarbon, the maximum molecular weight M of which is not more than 378, and an additive of not less than 3% by weight containing alcohol or carboxylic acid, the maximum molecular weight of which is not more than 378, wherein the maximum molecular weight of one of the base oil and the additive is not less than 282. When the above processing oil is used, it is possible to provide the same processing property as that of the conventional processing oil.

[4] Investigation into the Deoiling Property

Figure 4:
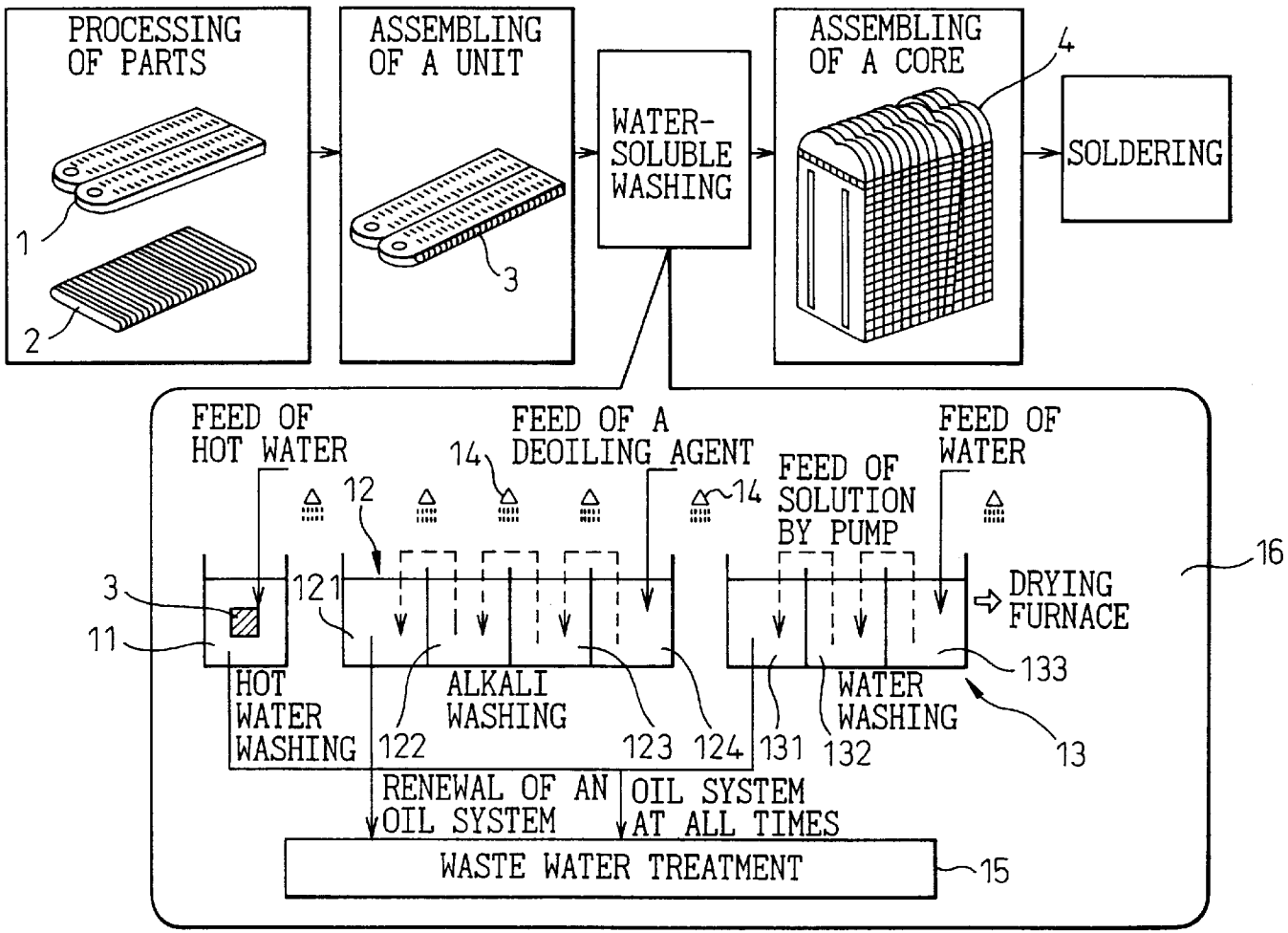
Fig. 4 PRIOR ART
FIG. 4 is a schematic illustration showing a conventional deoiling process.

In the case where the rate of processing of aluminum materials is not so high, importance is attached to the deoiling property of processing oil more than the processing property. For example, when the shapes of parts are relatively complicated, or when deoiling is carried out after the core has been incorporated in the after-process shown in FIG. 4, it is difficult to remove the adhering oil from all corners of the parts. Therefore, it is necessary to provide a high deoiling property. From the viewpoint of reducing the heating cost and shortening the heating time, it is preferable that the deoiling property is high as long as an appropriate processing property can be obtained and the occurrence of lubricant starvation can be prevented.

One means for enhancing the deoiling property is described as follows. In order to lower the complete evaporation temperature T, hydrocarbon, the maximum molecular weight M of which is smaller than 282, is used as a base oil which is mostly processing oil, and in order to prevent the occurrence of lubricant starvation, alcohol or carboxylic acid is added, the maximum molecular weight M of which is not less than 282 so that the evaporation speed V at the ordinary temperature can be maintained sufficiently low. In order to make the complete evaporation temperature T to be lower than 200° C., the maximum molecular weight of this alcohol or carboxylic acid is determined to be not more than 378. An example of usable carboxylic acid, the maximum molecular weight M of which is not less than 282 and not more than 378, is stearic acid, the molecular weight of which is 284.

In order to further enhance the deoiling property, it is possible to consider a combination of hydrocarbon of which the maximum molecular weight M is smaller than 282 to be used as a base oil, with alcohol or carboxylic acid of which the maximum molecular weight M is not more than 282 to be used as a first additive. However, the above composition is disadvantageous in that there is a tendency of the occurrence of lubricant starvation in the case of stoppage of the apparatus, because both vapor evaporation speed V of the base oil and that of the first additive are high.

Figure 10:
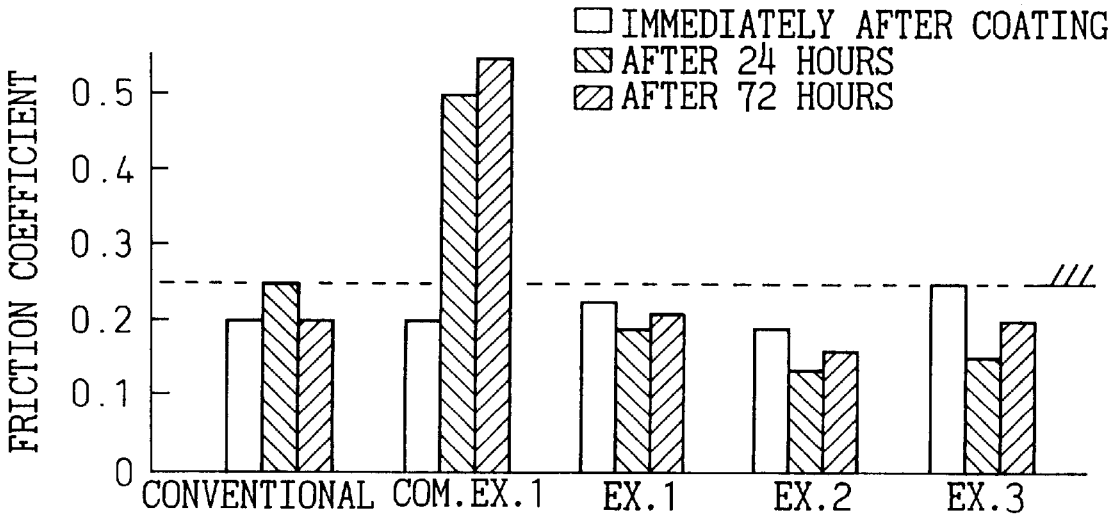
FIG. 10 is a characteristic diagram showing a relation between the concentration of additive and the change in the friction coefficient with elapsed time.

FIG. 10 is a graph showing a comparison of the lubricant starvation between the conventional processing oil for steel materials in which grease of which the maximum molecular weight M was 880 was added to mineral oil, and the processing oil of Comparative Example 1 in which alcohol of 5% by weight of which the maximum molecular weight M was not more than 282 was added to hydrocarbon of paraffin group of which the maximum molecular weight M was 212. In this case, the occurrence of lubricant starvation was evaluated in the following manner. Processing oil of the conventional example was coated on a sample, and also processing oil of Comparative Example 1 was coated on a sample. The maximum friction coefficient was measured by the Bouden Testing Method immediately after the completion of coating, after 24 and after 72 hours. In the case of processing oil of the conventional example, the friction coefficient was low, that is, the friction coefficient was 0.2 even after 72 hours. However, in the case of processing oil of Comparative Example 1, the friction coefficient was raised to about 0.5 after 24 hours. Due to the foregoing, it can be judged that the lubricant starvation occurred in 24 hours in Comparative Example 1.

In the same manner as that described above, changes in the friction coefficient with time were observed with respect to Examples 1, 2 and 3 described below. Example 1 was a processing oil in which an ester, at 0.25% by weight, the maximum molecular weight M of which was 299, was added to the composition of Comparative Example 1. Example 2 was a processing oil in which an ester at 0.5% by weight, the maximum molecular weight M of which was 299, was added to the composition of Comparative Example 1. Example 3 was a processing oil in which an ester at 1.0% by weight, the maximum molecular weight M of which was 299, was added to the composition of Comparative Example 1. The observed friction coefficients were compared with the friction coefficient 0.25 which was the highest friction coefficient shown in the conventional example. As a result, as illustrated in FIG. 10, it was found that the friction coefficient was maintained at a value not higher than 0.25 even after 72 hours when ester of 0.25% by weight, the maximum molecular weight M of which was 299, was added. The reason why is considered to be as follows. The maximum molecular weight M of ester is 299, which is larger than the maximum molecular weight M of 282 by which the processing oil is completely evaporated at the ordinary temperature after 72 hours. Consequently, if an ester of not less than 1% by weight, the maximum molecular weight M of which is not less than 282 and not more than 378, is added, it is possible to obtain a processing oil, the deoiling property of which is high, and by which the occurrence of lubricant starvation can be prevented. When an amount of ester to be added is increased, the deoiling property is deteriorated. For this reason, it is preferable that an amount of ester to be added is not more than 10% by weight, and it is more preferable that an amount of ester to be added is not more than 5% by weight.

In this connection, examples of alcohol, the maximum molecular weight M of which is smaller than 282 are: lauryl alcohol, the molecular weight of which is 186; isotridecyl alcohol, the molecular weight of which is 200; cetyl alcohol, the molecular weight of which is 242; and a mixture of these alcohols. An example of usable carboxylic acid, the maximum molecular weight of which is smaller than 282, is lauric acid, the molecular weight of which is 200. Further, examples of usable ester, the molecular weight of which is not less than 282 and not more than 378, are: oleic monoglyceride, the molecular weight of which is 344; glycerol monooleate, the molecular weight of which is 330; dibutyl sebacate, the molecular weight of which is 314; and mixture of the above chemical compounds.

According to the results of the above items [1] to [4], compositions usable for the processing oil of the present invention are shown on the following Table 2. In Table 2, each numeral indicates the maximum molecular weight M of each chemical compound.

TABLE 2

| | Base Oil Hydrocarbon | First Additive Alcohol or Carboxylic Acid (not less than 3 wt. %) | Second Additive Ester (not less than 1 wt. %) |
|---|---|---|---|
| Composition 1 | Not less than 282 and not more than 378 | Not more than 378 | — |
| Composition 2 | Smaller than 282 | Not less than 282 and not more than 378 | |
| Composition 3 | Smaller than 282 | Smaller than 282 | Not less than 282 and not more than 378 |

Composition 1 represents the processing oil in which importance is mostly attached to the processability. Compositions 2 and 3 represent the processing oil in which importance is attached to the deoiling property. When heating deoiling can be executed in the atmosphere and also when the required deoiling property is not so high, it is advantageous to use the processing oil of Composition 1 so that the material cost can be reduced. The reason is described as follows. Instead of synthesized hydrocarbon, mineral oil of which the cost is lower compared with the cost of synthesized hydrocarbon, can be used as the base oil, the maximum molecular weight M of which is not less than 282 and not more than 378.

In the case where press forming is conducted at a high rate of processing by the conventional processing oil used for steel materials, the processing oil of high viscosity is conventionally used. In this processing oil, hydrocarbon of which the average molecular weight is high is generally used as the base oil of high viscosity. As a result of the investigation, the inventors have discovered the following. In the case of processing oil used for processing aluminum materials, different from the processing oil used for processing steel materials, even if a base oil of low viscosity, the average molecular weight of which is approximately 183, is used, it is possible to obtain the same processability as that of the conventional processing oil of high viscosity when alcohol of not less than 3% by weight is added to the processing oil. Accordingly, selection of the base oil is not restricted by the average molecular weight, but the base oil may be selected in accordance with the maximum molecular weight M relating to the complete evaporation temperature T.

In this connection, not only the chemical compounds shown on Table 2 but also chemical compounds, the complete evaporation temperatures of which are not higher than 200° C., may be added to the processing oil of the present invention.

Next, a method of deoiling of the processing oil of the present invention, which has been obtained as a result of the above investigations, will be explained below.

Figure 11:
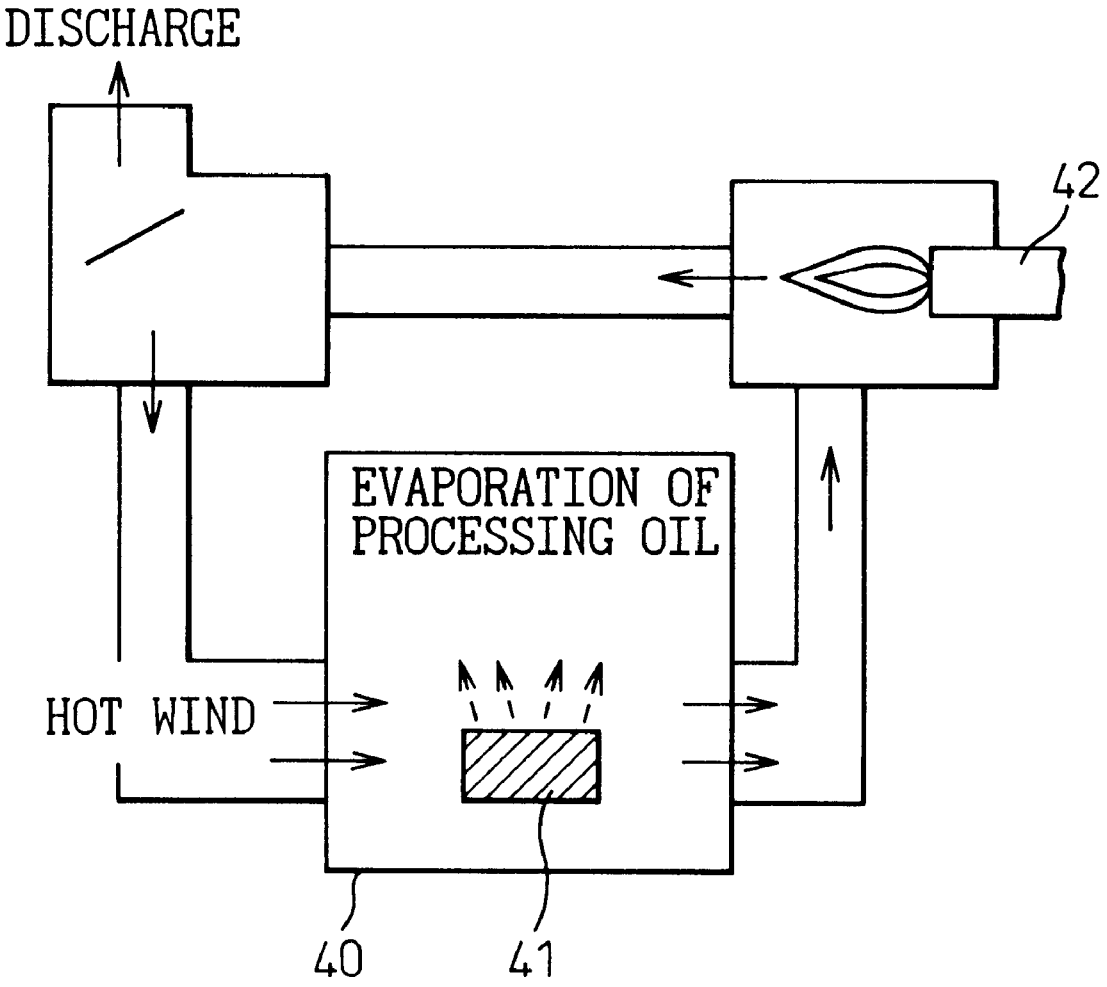
FIG. 11 is a schematic illustration showing an example of the heating deoiling process to be conducted in the atmospheric pressure in which processing oil of the invention is used.

FIG. 11 is a schematic illustration showing an example of the process of heating deoiling conducted in the atmosphere after press forming in which the processing oil of the present invention was used.

In the evaporation chamber 40 in which the pressure is maintained at the atmospheric pressure, the work piece 41, which is an aluminum member subjected to press forming, is heated to a temperature not higher than 200° C., so that the processing oil is evaporated. The thus evaporated processing oil is burned by the after-burner 42 and discharged outside. A portion of the heat generated when the processing oil was burned is used for controlling the temperature in the evaporation chamber 40. The evaporated processing oil may be recovered and recycled.

According to the process of heating deoiling conducted in the atmosphere shown in FIG. 11, deoiling is conducted at atmospheric pressure. Therefore, it is unnecessary to provide a vacuum heating apparatus. Accordingly, the total cost of deoiling can be reduced. When the base oil or additive, the evaporation speed at the ordinary temperature of which is not higher than a predetermined value, is used, it is possible to prevent the occurrence of lubricant starvation in the stoppage of the apparatus. Compared to the conventional water-soluble washing, the deoiling method of the present invention is advantageous in that no waste solution is generated in the process of deoiling, so that the environment is seldom affected.

Of course, when the processing oil of the present invention is used being combined with the heating deoiling apparatus described before, the most preferable effect can be provided.

We claim:

1. A processing oil for processing aluminum materials, the processing oil comprising:

at least one hydrocarbon base oil having a maximum molecular weight not less than 282 and not more than 378; and not less than 3% by weight of at least one additive selected from the group consisting of alcohols and carboxvlic acids, the additive having a maximum molecular weight not more than 378, wherein the processing oil is removable from aluminum materials by heating.

2. A processing oil according to claim 1, wherein the processing oil consists of the base oil and the additive.

3. A processing oil according to claim 2, wherein the additive is present in the processing oil a concentration of from 3% by weight to 20% by weight.

4. A processing oil for processing aluminum materials, the processing oil comprising:

at least one hydrocarbon base oil having a maximum molecular weight smaller than 282; and not less than 3% by weight of at least one additive selected from the group consisting of alcohols and carboxylic acids, the additive having a maximum molecular weight not less than 282 and not more than 378, wherein the processing oil is removable from aluminum materials by heating.

5. A processing oil according to claim 4, wherein the processing oil consists of the base oil and the additive.

6. A processing oil according to claim 4, wherein the additive is present in the processing oil in a concentration of from 3% by weight to 20% by weight.

7. A processing oil for processing aluminum materials, the processing oil comprising:

at least one hydrocarbon base oil having a maximum molecular weight smaller than 282;

not less than 3% by weight of a first additive selected from the group consisting of alcohols and carboxylic acids, the first additive having a maximum molecular weight smaller than 282; and not less than 0.25% by weight of an ester as a second additive, the ester having a maximum molecular weight not less than 282 and not more than 378, wherein the processing oil is removable from aluminum materials by heating.

8. A processing oil according to claim 7, wherein the first additive is present in the processing oil in a concentration of from 3% by weight to 20% by weight and the second additive is present in a concentration of from 0.25 by weight to 10% by weight.

9. A processing oil according to claim 1, wherein the additive comprises a carboxylic acid.

10. A processing oil according to claim 4, wherein the additive comprises a carboxylic acid.

11. A processing oil according to claim 7, wherein the first additive comprises a carboxylic acid.

* * * * *